US005857309A

United States Patent [19]

Cicha et al.

[11] Patent Number: 5,857,309

[45] Date of Patent: Jan. 12, 1999

[54] APPARATUS FOR STERILIZING A SPOUT ASSEMBLY OF A CONTAINER

[75] Inventors: John Cicha, Shoreview; Steven Breuer, St. Paul; John Kretlow, St. Anthony, all of Minn.

[73] Assignee: Tetra Laval Holdings & Finance, S.A., Pully, Switzerland

[21] Appl. No.: 828,343

[22] Filed: Mar. 28, 1997

[51] Int. Cl.[6] ..... B65B 55/04

[52] U.S. Cl. ..... 53/167; 53/133.2; 53/133.4; 493/87

[58] Field of Search ..... 250/455.11; 422/24; 493/87, 231; 53/412, 425, 426, 167, 133.1, 133.2, 133.3, 133.4

[56] References Cited

U.S. PATENT DOCUMENTS

| | | | |
|---|---|---|---|
| 3,050,914 | 8/1962 | Morgan, Jr. . | |
| 3,335,890 | 8/1967 | Grundmann et al. . | |
| 3,783,581 | 1/1974 | Pierce . | |
| 4,494,363 | 1/1985 | Rica et al. . | |
| 4,563,855 | 1/1986 | Smith et al. . | |
| 4,788,811 | 12/1988 | Kawajiri et al. . | |
| 4,981,649 | 1/1991 | Shibauchi et al. | 53/167 X |
| 4,987,721 | 1/1991 | Turtschan | 53/426 X |
| 5,053,196 | 10/1991 | Ide et al. . | |
| 5,123,229 | 6/1992 | Dardaine et al. | 53/426 |
| 5,129,212 | 7/1992 | Duffey et al. . | |
| 5,219,320 | 6/1993 | Abrams et al. | 493/87 X |
| 5,251,423 | 10/1993 | Turtschan . | |
| 5,267,934 | 12/1993 | Pape et al. | 53/133.2 X |
| 5,377,475 | 1/1995 | Haarer et al. . | |
| 5,429,699 | 7/1995 | Abrams et al. | 493/87 X |
| 5,435,803 | 7/1995 | Owen et al. | 53/410 X |
| 5,467,581 | 11/1995 | Everette | 53/133.2 |
| 5,473,857 | 12/1995 | Keeler | 53/133.2 X |
| 5,484,374 | 1/1996 | Bachner et al. | 53/133.2 X |
| 5,601,669 | 2/1997 | Moody et al. | 493/213 X |
| 5,653,832 | 8/1997 | Thompson et al. | 493/213 X |

FOREIGN PATENT DOCUMENTS

| | | | |
|---|---|---|---|
| 0447759 | 9/1991 | European Pat. Off. | 53/426 |
| 3009202 | 9/1981 | Germany | 53/426 |
| 0219725 | 9/1990 | Japan | 53/426 |
| 551019 | 3/1993 | Japan | 53/167 |
| 656132 | 3/1994 | Japan | 53/426 |
| 6179429 | 6/1994 | Japan | 53/426 |

*Primary Examiner*—Daniel B. Moon
*Attorney, Agent, or Firm*—Michael A. Catania

[57] ABSTRACT

An apparatus for providing a container having a spout assembly disposed thereon, the spout assembly comprising a cap disposed on a fitment having an interior portion for disposition toward the container interior and an exterior portion for disposition toward the container exterior. The apparatus comprises a storage bin for storing plural spout assemblies and a guide assembly for guiding the spout assemblies to an output of the guide assembly. A fitment and cap sterilizer accepts the spout assemblies from the output and applies a disinfecting solution to their interior portions. An output guide assembly guides them to a subsequent processing station such as a spout applicator that applies the spout assembly to the container. An intermediate UV station may be used between the fitment and cap sterilizer and the spout applicator. In one embodiment, the fitment and cap sterilizer comprises a track for guiding the spout assemblies along a predetermined path. A gate mechanism selectively retains the spout assemblies at a predetermined position along the track. A sprayer is disposed in fixed alignment with a spout assembly that has been retained for spraying the retained spout assembly with a disinfecting solution.

22 Claims, 5 Drawing Sheets

APPARATUS FOR STERILIZING A SPOUT ASSEMBLY OF A CONTAINER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Conventional bottles for preserving liquid drinks and the like are being gradually replaced by paper packages. Such packages are generally comprised of a blanks made from a paperboard substrate that is sandwiched between layers of a thermoplastic material. These blanks are side-sealed and presented to the input of a packaging machine. The packaging machine erects these blanks, seals their bottoms, charges them with product, and seals their tops.

A number of such package-types have now come into common use. One such package type is the gable-top container. Another such package type is the brick-type container. In many instances, it has become popular to provide such containers with a spout assembly comprising a fitment and a cap that provides the container with a resealable opening that provides quick and simple access to the container contents.

A packaging machine that is designed to form and seal a package with such a spout assembly is set forth in U.S. Pat. No. 4,788,811, entitled "Process and Apparatus for Assembling and Liquor-Charging of Packages of Paper and the Like". The device disclosed in the '811 patent purports to be an apparatus for the successive production of a number of paper packages fitted with respective spout on a part of the top end portion thereof and charged with a liquid drink. The spout includes a spout proper having a general cylindrical are configuration and formed generally therethrough with a liquid spouting passage provisionally fixed to the root end of the spout proper. For better sanitary purposes, the spout is introduced into the open and of a semi-package from inside thereof. The spout introduction and attaching job is carried out directly before charging with liquid. Only thereafter, liquid charging-in and top-closing jobs are carried out in a sterilized atmosphere. Within the sanitary execution of these jobs, the spout agency and sealing attachment are included for increasing the sanitary safety.

As such packages have increased in popularity, the demands on the shelf-life of the contents have likewise increased. The shelf-life is directly dependent on the sterility of the packaging process. The foregoing system described in the '811 patent, however, does not provide the sterility required to achieve such extended shelf-lives. The present inventors have found that the current processes for sterilizing a carton prior to charging with the product often neglect a significant potential source of contamination. Accordingly, they have provided the invention disclosed and described herein.

SUMMARY OF THE INVENTION

An apparatus for providing a container having a spout assembly disposed thereon is disclosed. The spout assembly comprises a cap disposed on a fitment and may be functionally divided between an interior portion for disposition toward the interior of the container and an exterior portion for disposition toward the exterior of the container. The apparatus comprises a storage bin for storing a plurality of the spout assemblies and a guide assembly for guiding the plurality of spout assemblies to present them individually at an output of the guide assembly. A fitment and cap sterilizer accepts individual ones of the plurality of spout assemblies from the output of the guide assembly and applies a disinfecting solution to their respective interior portions. An output guide assembly accepts the individual ones of the spout assemblies after they have had their interior portions disinfected and guides them to a subsequent processing station. The subsequent processing station may, for example, be a spout applicator that applies the spout assembly to the container. An intermediate UV station may be used between the fitment and cap sterilizer and the spout applicator to further sterilize the spout assemblies prior to application.

In accordance with one embodiment of the fitment and cap sterilizer, the fitment and cap sterilizer comprises a track for supporting and guiding a plurality of the spout assemblies along a predetermined path. A gate mechanism is disposed to interrupt movement of the plurality of spout assemblies along the track The gate assembly is operable to selectively retain individual ones of the spout assemblies at a predetermined position along the track and selectively pass the retained spout assembly for further travel along the track. A sprayer is disposed in fixed alignment with a spout assembly that has been retained at the predetermined position by the gate assembly for spraying the retained spout assembly with a disinfecting solution.

DETAILED DESCRIPTION OF THE INVENTION

Figure 1:
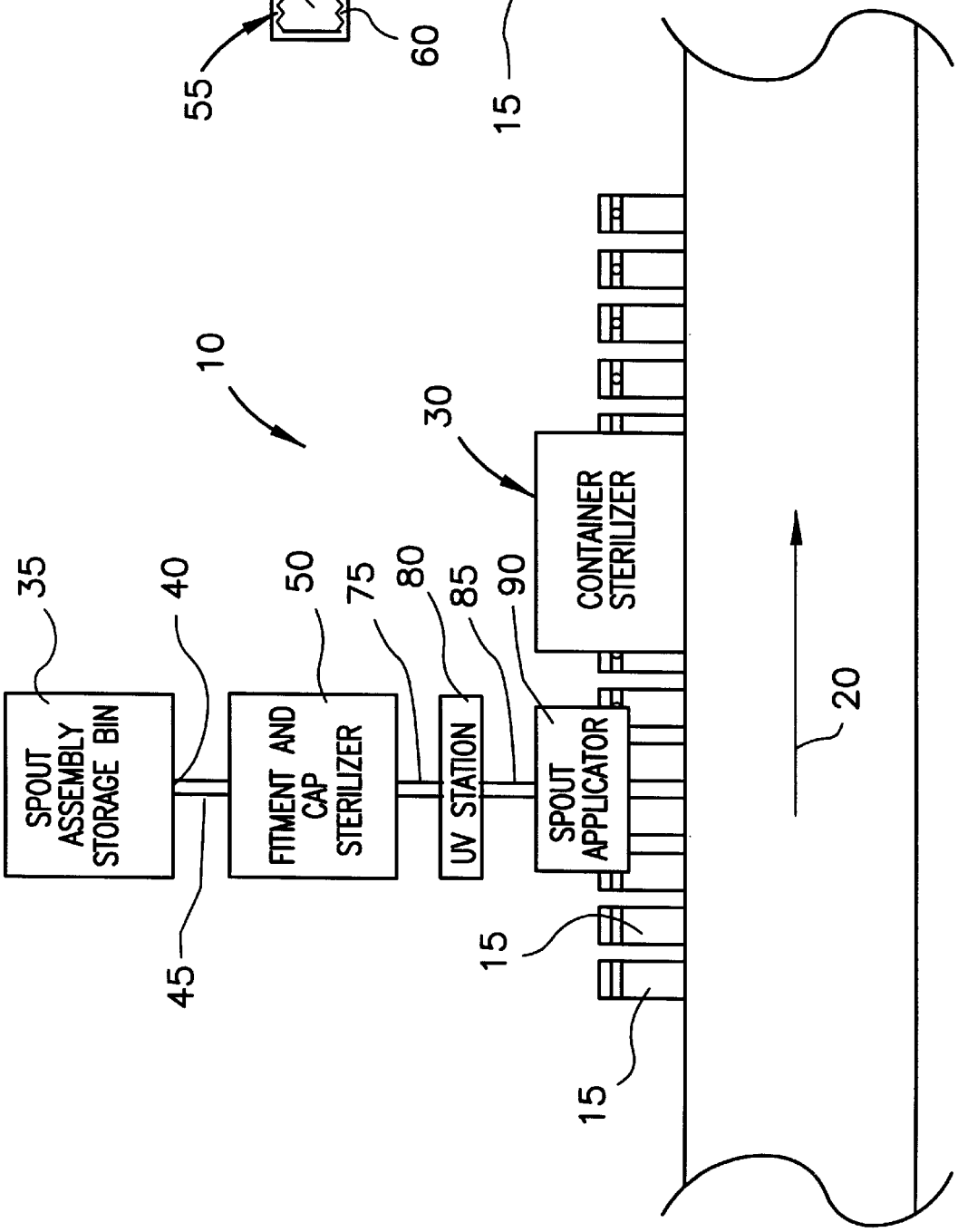
FIG. 1 is a diagrammatic view of a spout application station and container sterilization station of a packaging machine in accordance with one embodiment of the present invention.

One embodiment of an apparatus for providing a container, such as a gable-top container, having a spout assembly disposed thereon is set forth generally at 10 of FIG. 1. In the apparatus 10, a plurality of containers 15 are transported between successive processing stations in the direction indicated by arrow 20 by, for example, an endless belt conveyor (not illustrated). Two such processing stations are illustrated here. A first processing station 25 is provided to attach a spout assembly to each of the containers 15. In accordance with one aspect of the present invention, the spout assemblies are sterilized prior to such attachment thereby providing a more sterile packaging process that gives rise to a naturally extended shelf life for the product. A second processing station 30 is provided to sterilize the interior portions of the containers 15.

As illustrated, the first processing station 25 comprises a spout assembly storage bin 35 that is used to store a plurality of spout assemblies. The storage bin 35 comprises an outlet 40 attached to the input of a length of spout assembly track 45. The spout assembly track 45 extends between the storage bin 35 and the input of a fitment and cap sterilizer 50 and facilitates transport of spout assemblies therebetween. Preferably, the spout assemblies are transported along the track 45 using gravity and, if necessary, bursts of sterile air or the like.

The fitment and cap sterilizer 50 functions as a disinfecting assembly that accepts individual ones of that are serially transported along the track 45 Disinfection proceeds by applying a disinfecting solution, such as hydrogen peroxide, to the spout assemblies.

Figure 2:
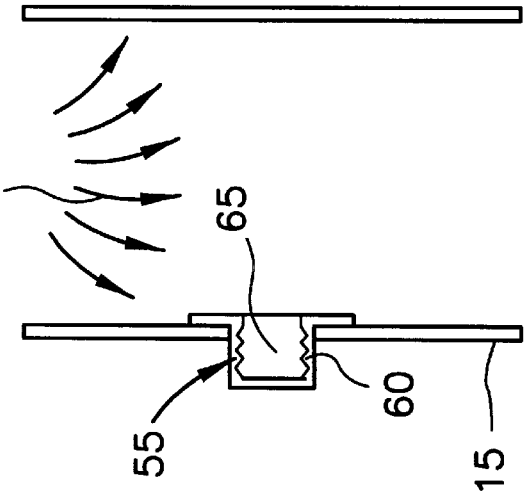
FIG. 2 is view of a cross-section of a spout assembly that has been applied to a container wherein the container is undergoing a post-application sterilization process.

Notably, the fitment and cap sterilizer 50 applies an amount of the disinfecting solution to an interior portion of the spout assemblies. In this respect, it is noted with respect to FIG. 2 that each spout assembly 55 may be functionally comprised of two sections: an exterior section 60 that, upon application to the respective container 15 is disposed toward the exterior of the container and, further, an interior section 65 that, upon application to the respective container, is disposed toward the interior of the container 15. Generally, as illustrated in FIG. 2, sterilization of the interior sections of the spout assemblies is neglected in that the interior sections are difficult to access once the spout assemblies have been attached to the respective container. For example, a dispersion of hydrogen peroxide, illustrated here with arrows 70 fails to reach certain interior portions of the spout assembly 55. Such regions effectively become "shadowed" regions that do not receive an application of hydrogen peroxide. Accordingly, post-attachment container sterilization frequently leaves substantial portions of the spout assembly 55 in a septic state that can contaminate the container contents and, thereby, lowers the effective shelf life. By applying the sterilizing solution to the interior portion of the spout assembly prior to application to the container, such problems are reduced and/or eliminated.

After each spout assembly has been disinfected by the fitment and cap sterilizer 50, it is provided to an output guide assembly 75 which guides each of the spout assemblies to a subsequent processing station. In the exemplary embodiment illustrated in FIG. 1, each spout assembly is subsequently provided to an optional ultraviolet station 80. The ultraviolet station 80 irradiates each spout assembly, particularly the interior portion thereof, as it passes therethrough. Such irradiation, particularly when combined with an application of hydrogen peroxide as the disinfecting solution, provides for a very effective sterilization of the spout assembly.

After irradiation at the ultraviolet station 80, each spout assembly is guided along track 85 to a spout applicator 90 that applies the spout assembly to the respective container 15. The spout applicator 90 can take on any number of forms. For example, the spout applicator 90 may be an EL-64 such as available from Cambridge Valley Mach. Other spout applicators are likewise suitable for such use.

In the foregoing system, it is preferable to maintain the station 25 in a generally sterile environment. Accordingly, the station 25 may be provided with a circulation of sterile air. Additionally, or in the alternative, the station, or portions thereof, may be surrounded by sidewalls defining a sterile chamber or the like.

After application of the spout assembly to the respective container, the container and spout assembly are transported in the direction of arrow 20 by, for example, a chain conveyor or the like, to the further sterilization station 30. At the sterilization station 30, the container 15 undergoes a sterilization process that, for example, includes an application of hydrogen peroxide followed by irradiation with ultraviolet light. As noted above, conventional container sterilization processes often fails to adequately sterilize the internal portions of the spout assembly. Since the internal portions of the spot assembly have been sterilized at station 50, this does not present a problem. As such, it becomes possible to use a conventional process at sterilization station 30.

After undergoing the sterilization process at sterilization station 30, the containers 15 are conveyed to subsequent processing stations (not illustrated) where they are charged with product and top-sealed. Such charging and sealing operations are not particularly pertinent to the present invention and, for example, may be carried out using conventional processes.

Figure 3:
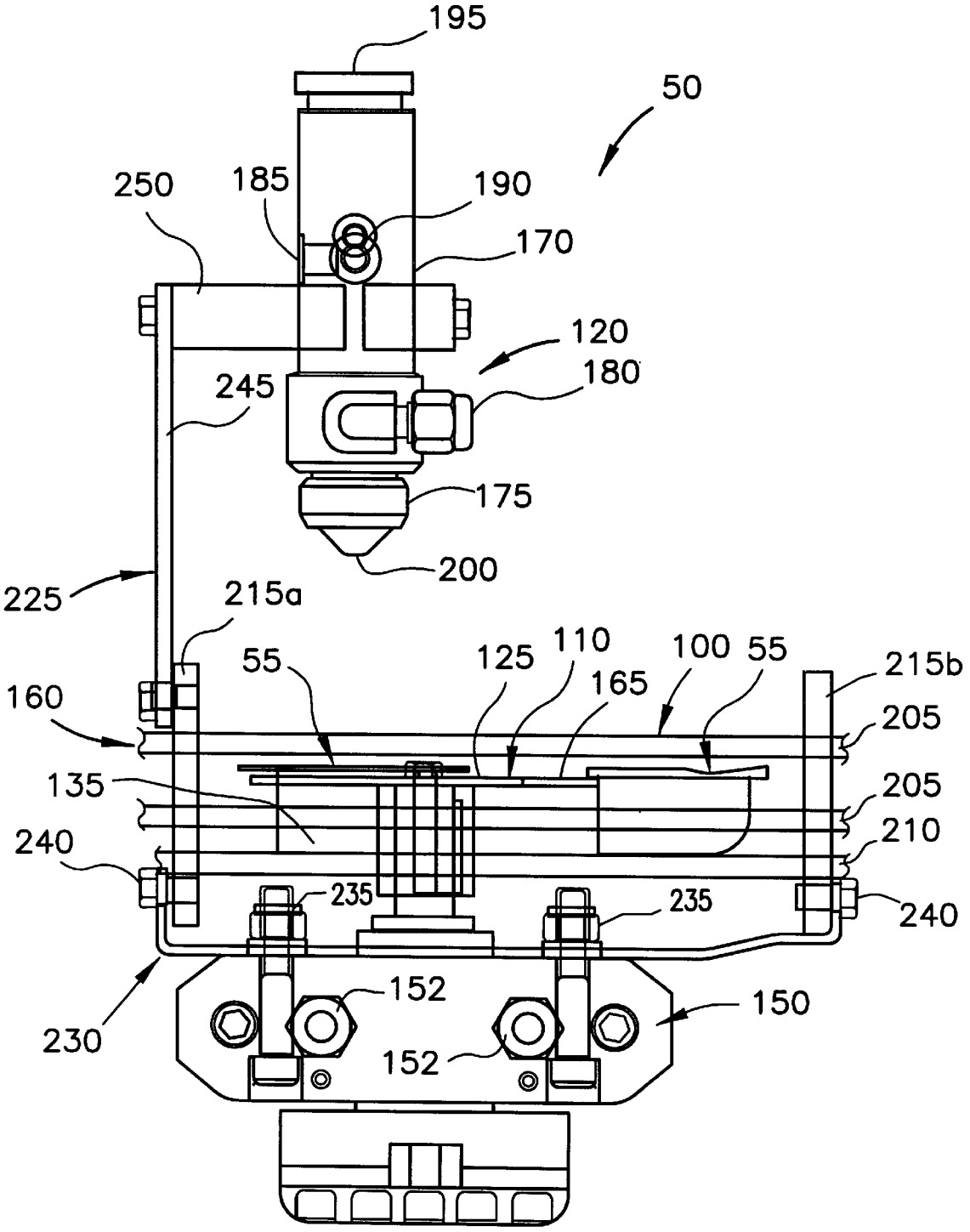
FIGS. 3–5 are various views of a fitment and cap sterilizer constructed in accordance with one embodiment of the present invention.
Figure 4:
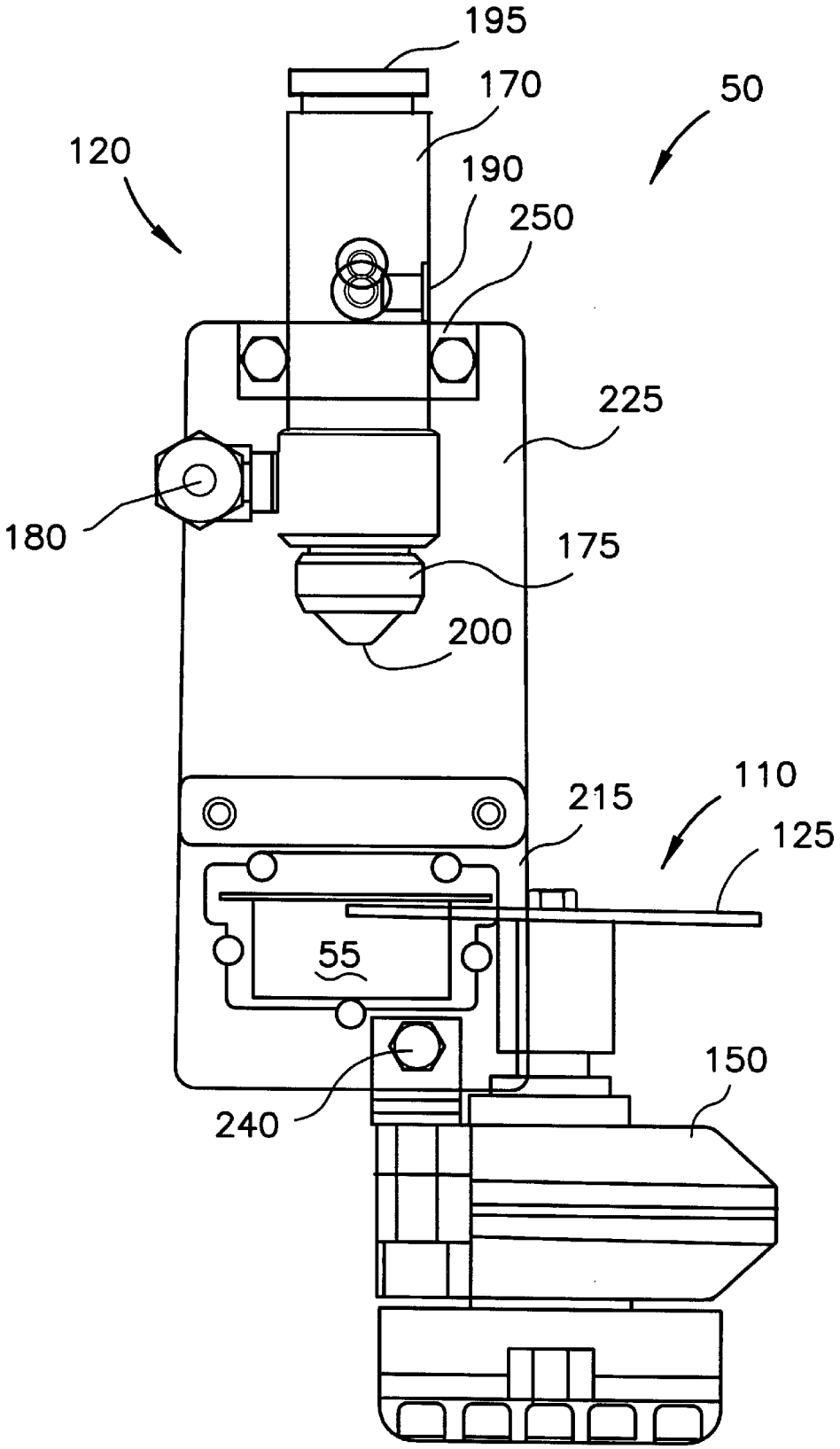
Figure 5:
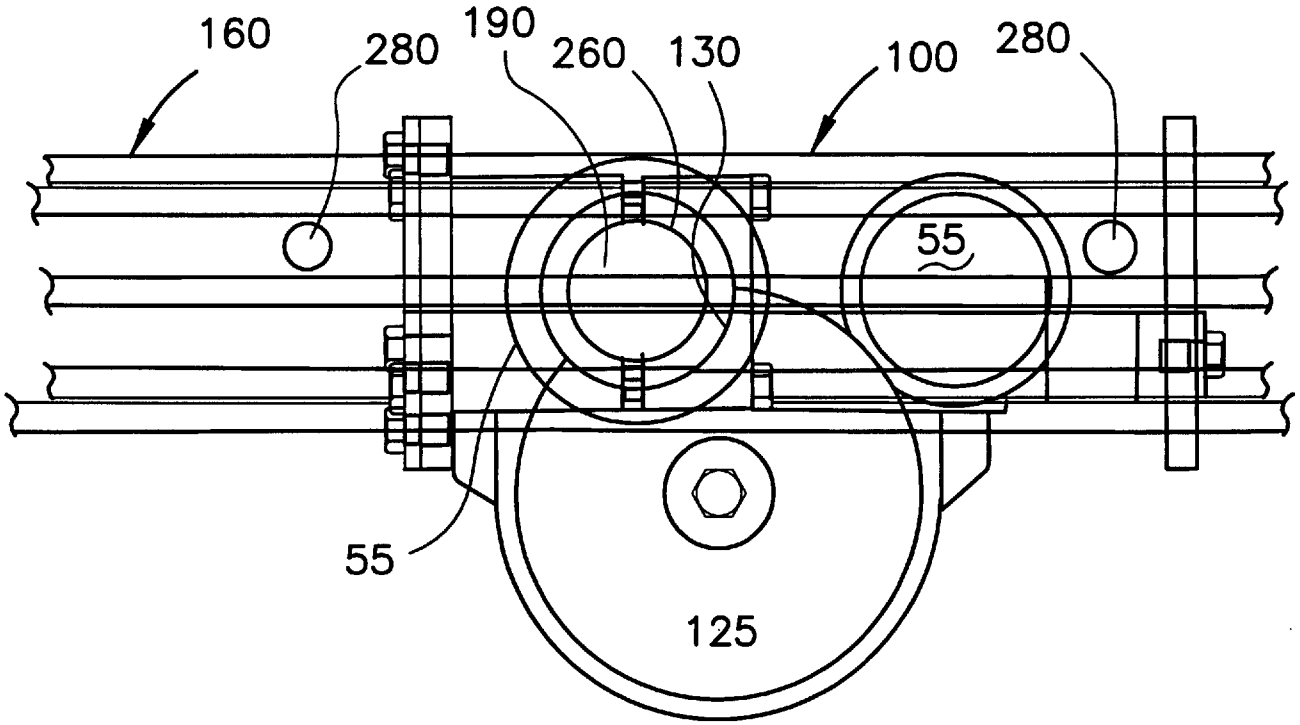

FIGS. 3–5 illustrate one embodiment of a fitment and cap sterilizer 50 that may be used in the station 25. As illustrated, the spout assemblies 55 are conveyed along a predetermined path that this defined by a track 100 of the fitment and cap sterilizer 50. A gate mechanism, shown generally at 110, is disposed to interrupt movement of the spout assemblies 55 along the track 100. More particularly, the gate mechanism 110 is operable to selectively retain individual ones of the spout assemblies 55 at a predetermined position along the track 100 while a spray mechanism, shown generally at 120 sprays the interior portion of each spout assembly 55 with a disinfecting solution, such as hydrogen peroxide. After the individual spout assembly 55 has been sprayed, it is selectively passed for further travel along the track 100.

The particular embodiment of the gate mechanism 120 utilizes a circular gate 125 having a cutout portion 130. The cutout portion 130 corresponds to the shape of the cap portion 135 of an individual spout assembly 55 and engages a peripheral portion thereof. As illustrated, the circular gate 125 is disposed to interrupt travel of the spout assemblies 55 along the track 100. In operation, the gate 125 is rotated by an actuator 150 in response to control signals received at one or more inputs 152. The actuator 150 rotates the gate 125 between a first position in which the gate 125 engages and retains an individual spout assembly 55 in the cutout portion 130 at a predetermined position and a second position in which the gate 125 passes the retained, individual spout assembly 55 to an outlet portion 160 of the track 100. When passing the previously retained, individual spout assembly 55 to the outlet portion 160, the rearward portion 165 of the circular gate 125 engages a subsequent one of the spout assemblies 55 thereby preventing further spout assemblies from passing through the fitment and cap sterilizing station 50. As such, each spout assembly 55 undergoes its own individual sterilizing process. Although the actuator 150 of the disclosed embodiment is responsive to a pneumatic control signal at inputs 152, it will be recognized that other actuators responsive to other types of actuating signals may also be used.

The spray mechanism 120 is disposed opposite the gate mechanism 110. Although the spray mechanism 120 and gate mechanism 110 are illustrated in a vertical orientation, it will be recognized that a horizontal orientation is preferable if gravity is to be used to convey the spout assemblies along the track. The spray mechanism 120 comprises a body portion 170 and a nozzle portion 175. The body portion 170 includes a first inlet 180 for receiving sterile atomizing air or the like. The body portion 170 further includes a second inlet 185 for receiving the disinfecting solution, such as hydrogen peroxide. An actuating input 190 is also provided to accept an actuating control signal, such as an electronic signal or pneumatic signal that initializes the operation of a spray cycle. Upon receipt of an actuating control signal, the spray mechanism 120 provides a predetermined amount of disinfecting solution and a predetermined amount of sterile atomizing air, combining the two for dispersion through the nozzle 175. The amount of solution and air that are utilized in a single dispersion are controllable to a very high degree. Preferably, the spray mechanism nozzle is a Model 780S-SS available from EFD.

The size of the opening in the nozzle 175 can be controlled through a screw mechanism having a first end 195 that may be gripped and turned by an operator. The first end 195 is connected to a centralized rod (not illustrated) that extends to a second narrowed end disposed proximate the nozzle opening 200. The degree to which the second narrowed end obstructs the nozzle opening 200, as adjusted by turning of the first end 195, adjusts the effective size of the opening.

Figure 6:
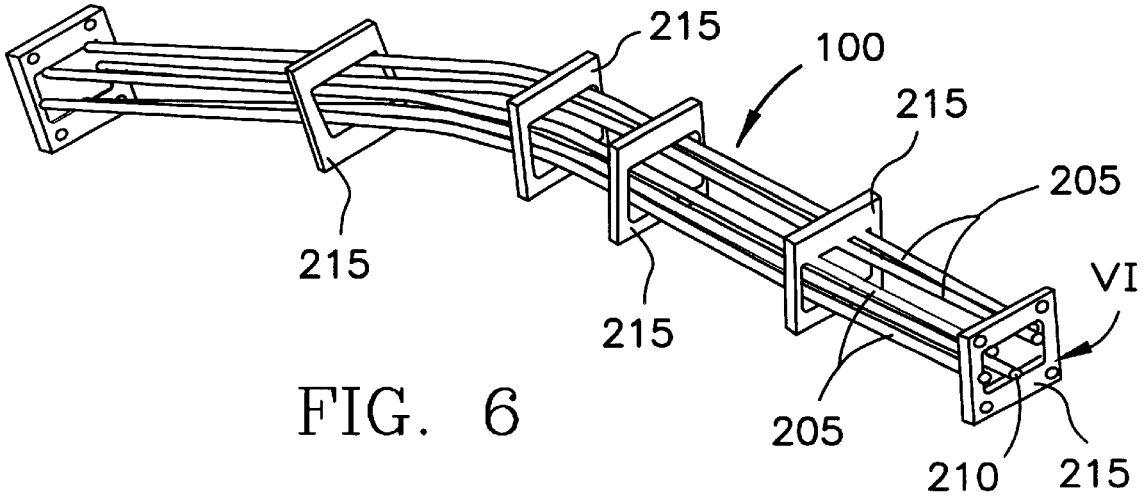
FIG. 6 is a perspective view of one embodiment of a track assembly for use in the present invention.
Figure 7:
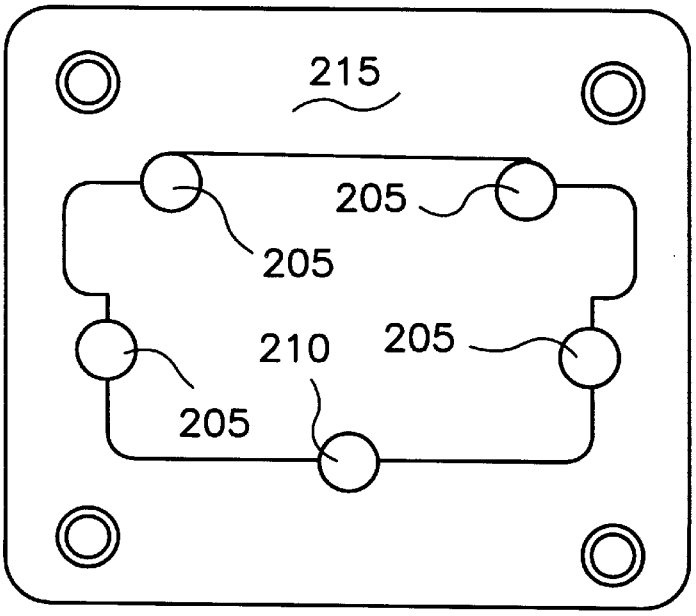
FIG. 7 is an end view of the track assembly illustrated in FIG. 6.

In the illustrated embodiment, the gate mechanism 110 and the spray mechanism 120 are secured to the track 100 which provides support for the spout assemblies 55 as they pass through and are processed by the fitment and cap sterilizer 50. More particularly, as illustrated in detail in the exemplary sections of FIGS. 6–7, as well as in FIGS. 3 and 4, the track 100 is comprised of four side rails 205 and a support rail 210. The rails 205 and 210, in turn, are supported by support members 215 that are disposed at predetermined positions along the track. The spray mechanism 120 and gate mechanism 110 are secured to at least one of these support members 215 by brackets 225 and 230, respectively. As shown in detail in FIG. 3, the actuator 150 of the gate mechanism 110 is secured to bracket 230 by, for example, bolts 235. Bracket 230 straddles between support members 215*a* and 215*b* and is connected by a pair of bolts 240.

Bracket 225 connecting the spray mechanism 120 to support member 215*a* is comprised of an upstanding portion 245 that is secured to a laterally extending portion 250. Laterally extending portion 250 includes an aperture 260 that engages and secures to the body portion 170 of the spray mechanism 120 thereby placing the nozzle 175 in a predetermined position coinciding with the position of the individual spout assembly engaged by the circular gate 125 when the circular gate is in its first position. Notably, the track 100 is arranged to present the individual spout assemblies at the fitment and cap sterilizer 50 with the interior portions thereof exposed to the spray of disinfecting solution provided by the spray mechanism 125. As such, the interior portions of the spout assembly are properly sterilized prior to securing it on the container.

Sensors 280, such as LED sensors or the like, may be disposed along the track 100 at predetermined positions before and after the fitment and cap sterilizer 50. Such sensors 280 may be used to monitor the backlog of spout assemblies 55 before and after the sterilizer 50 to thereby indicate a system malfunction, a requirement for more spout assemblies in the bin 35, etc.

Coordination and control of the spray mechanism 120 and gate mechanism 110 preferably is provided by a centralized control system (not illustrated) that, for example, may be comprised of a programmable logic controller (PLC) or the like. Even more preferably, the PLC is used to coordinate and control the operation of the entire packaging machine.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

We claim:

1. An apparatus for providing a container having a spout assembly disposed thereon, the spout assembly comprising a cap disposed on a fitment, the spout assembly further comprising an interior portion for disposition toward the interior of the container and an exterior portion for disposition toward the exterior of the container, the apparatus comprising:

a storage bin for storing a plurality of the spout assemblies;

a guide assembly for guiding the plurality of spout assemblies to present them individually at an output of the guide assembly;

a fitment and cap sterilizer accepting the individual ones of the plurality of spout assemblies from the output of the guide assembly and applying a disinfecting solution to an interior portion of the individual ones of the plurality of spout assemblies;

an output guide assembly accepting individual ones of the plurality of spout assemblies and guiding them to a subsequent processing station.

2. An apparatus as claimed in claim 1 wherein the subsequent processing station is an ultraviolet station for irradiating the interior portion of each of the spout assemblies.

3. An apparatus as claimed in claim 1 wherein the subsequent processing station is a spout assembly applicator that attaches each spout assembly to a respective container.

4. An apparatus as claimed in claim 3 wherein the container is ultimately formed as a gable-top container.

5. An apparatus as claimed in claim 1 wherein the subsequent processing station is an ultraviolet station for irradiating the interior portion of each spout assembly, the apparatus further comprising:

a further guide assembly having an input connected to receive spout assemblies from the ultraviolet station, the further guide assembly having an output;

a spout assembly applicator connected to receive spout assemblies from the output of the further guide assembly, the spout assembly applicator attaching each spout assembly to a respective container.

6. An apparatus as claimed in claim 5 wherein the container is ultimately formed as a gable-top container.

7. An apparatus as claimed in claim 1 wherein the container is ultimately formed as a gable-top container.

8. An apparatus as claimed in claim 1 and further comprising: an endless conveyor supporting the plurality of containers;

a container sterilizing station for sterilizing the interior portions of the container by spraying the interior portions of the container with a disinfecting solution and subsequently irradiating the interior portions of the container with ultraviolet light, the endless belt conveyor transporting each of the plurality of containers between the spout assembly applicator and the container sterilizing station.

9. An apparatus for disinfecting a spout assembly for subsequent application on a container, the spout assembly comprising a cap disposed on a fitment, the spout assembly further comprising an interior portion for subsequent disposition toward the interior of the container and an exterior portion for subsequent disposition toward the exterior of the container, the apparatus comprising:

a track for supporting and guiding a plurality of the spout assemblies along a predetermined path;

a gate mechanism disposed to interrupt movement of the plurality of spout assemblies along the predetermined path, the gate assembly being operable to selectively retain individual ones of the spout assemblies at a predetermined position along the predetermined path and to selectively pass the retained spout assembly for further travel along the predetermined path;

a spray mechanism disposed in fixed alignment with a spout assembly retained at the predetermined position for spraying the retained spout assembly with a disinfecting solution.

10. An apparatus as claimed in claim 9 wherein the disinfecting solution this hydrogen peroxide.

11. An apparatus as claimed in claim 9 wherein the gate mechanism comprises a circular gate having a cutout portion disposed along a periphery thereof, the cutout portion generally corresponding to the shape of an individual spout assembly, the circular gate being disposed to interrupt travel of the spout assemblies along the track, the circular gate further being operable to rotate between a first position in which the gate engages and retains individual ones of the spout assemblies in the cutout portion and a second position in which the gate passes the retained spout assembly while preventing the passing of further spout assemblies disposed upstream from the gate mechanism.

12. An apparatus as claimed in claim 11 and further comprising a pneumatic actuator connected to the gate to rotate the gate between the first and second positions.

13. An apparatus as claimed in claim 9 wherein the spray mechanism comprises:

a body portion having a first inlet for receiving sterile atomizing air, a second inlet for receiving the disinfecting solution, and an actuating signal input;

a nozzle disposed at an end of the body portion proximate the predetermined position.

14. An apparatus as claimed in claim 13 and further comprising:

a first bracket connecting the spray mechanism to the track at the predetermined position;

a second bracket connecting the gate mechanism to the track at the predetermined position.

15. An apparatus as claimed in claim 9 wherein the spray mechanism sprays the interior portion of the retained spout assembly with the disinfecting solution.

16. An apparatus as claimed in claim 9 wherein the track supports a retained spout assembly so that its interior portion is exposed to the spray mechanism to allow the spray mechanism to spray the disinfecting solution on the surfaces of the interior portion of the retained spout assembly.

17. A fitment and cap sterilizer for sterilizing an interior portion of a spout assembly prior to application of the spout assembly to a container, the sterilizer comprising:

a track for guiding the spout assembly through the sterilizer;

a gate disposed at a predetermined position along the track for controlling the movement of the spout assembly at the predetermined position along the track;

a sprayer disposed opposite the gate at the predetermined position to spray the interior portion of the spout assembly with a disinfecting solution.

18. A fitment and cap sterilizer as claimed in claim 17 wherein the gate is a circular gate having a cutout portion disposed along a periphery thereof, the cutout portion generally corresponding to the shape of the spout assembly, the circular gate being disposed to interrupt travel of the spout assembly along the track at the predetermined position, the circular gate further being operable to rotate between a first position in which the gate engages and retains the spout assembly in the cutout portion and a second position in which the gate passes the retained spout assembly.

19. A fitment and cap sterilizer as claimed in claim 18 and further comprising a pneumatic actuator connected to the gate to rotate the gate between the first and second positions.

20. A fitment and cap sterilizer as claimed in claim 17 wherein the spray mechanism comprises:

a body portion having a first inlet for receiving sterile atomizing air, a second inlets for receiving the disinfecting solution, and an actuating signal input;

a nozzle disposed at an end of the body portion proximate the predetermined position.

21. A fitment and cap sterilizer for sterilizing an interior portion of a spout assembly prior to application of the spout assembly to a container, the sterilizer comprising:

a track for guiding the spout assembly through the sterilizer;

a circular gate disposed at a predetermined position along the track, the circular gate having a cutout portion adapted to mate with a peripheral portion of the spout assembly, the circular gate being rotatable between a first position in which it engages and holds the spout assembly at the predetermined position and a second position in which it passes the spout assembly while concurrently preventing other spout assemblies located upstream therefrom from passing the predetermined position;

an actuator for rotating the circular gate between its first and second positions;

a sprayer disposed opposite the circular gate at the predetermined position, the track being arranged to present the interior portion of the spout assembly to the sprayer, the spreader being operable to spray the interior portion of the spout assembly with a disinfecting solution.

22. A fitment and cap sterilizer as claimed in claim 21 wherein the sprayer comprises:

a body portion having a first inlet for receiving sterile atomizing air, a second inlet for receiving the disinfecting solution, and an actuating signal input;

a nozzle disposed at an end of the body portion proximate the predetermined position.

* * * * *